US007484294B2

(12) United States Patent
De Keyser et al.

(10) Patent No.: US 7,484,294 B2
(45) Date of Patent: Feb. 3, 2009

(54) METHOD AND APPARATUS FOR CRIMPING A CONTACT

(75) Inventors: Mark De Keyser, St. Esteve Sesrovires (ES); Isabelle Quesse, Panossas (FR); Flavio Fantini, Suresnes (FR)

(73) Assignee: FCI, Versailles (FR)

( * ) Notice: Subject to any disclaimer, the term of this patent is extended or adjusted under 35 U.S.C. 154(b) by 77 days.

(21) Appl. No.: 10/587,650

(22) PCT Filed: Jan. 25, 2005

(86) PCT No.: PCT/EP2005/000788

§ 371 (c)(1),
(2), (4) Date: Jul. 27, 2006

(87) PCT Pub. No.: WO2005/076410

PCT Pub. Date: Aug. 18, 2005

(65) Prior Publication Data

US 2007/0155235 A1 Jul. 5, 2007

(30) Foreign Application Priority Data

Jan. 27, 2004 (FR) ..... 04 00765

(51) Int. Cl.
*H01R 43/04* (2006.01)
*B23P 19/00* (2006.01)

(52) U.S. Cl. ..... 29/863; 29/750; 29/751; 29/753; 29/861; 29/862

(58) Field of Classification Search ..... 29/861, 29/862, 863, 750, 751, 753, 825
See application file for complete search history.

(56) References Cited

U.S. PATENT DOCUMENTS

| | | | | | |
|---|---|---|---|---|---|
| 2,535,013 | A | | 12/1950 | Freedom | 173/269 |
| 2,674,725 | A | * | 4/1954 | Buchanan | 439/882 |
| 2,724,098 | A | * | 11/1955 | Bergan | 439/879 |
| 3,322,008 | A | * | 5/1967 | Filia | 81/313 |
| 4,412,718 | A | * | 11/1983 | Pfister | 439/839 |
| 5,370,560 | A | * | 12/1994 | Ito | 439/877 |
| 5,692,294 | A | * | 12/1997 | Casey | 29/753 |

FOREIGN PATENT DOCUMENTS

| | | | |
|---|---|---|---|
| DE | 197 53 436 | A1 | 6/1999 |
| DE | 199 06 831 | A1 | 9/2000 |
| EP | 0 477 893 | A1 | 4/1992 |
| WO | WO 03/065508 | A1 | 3/2003 |

* cited by examiner

*Primary Examiner*—C. J Arbes
(74) *Attorney, Agent, or Firm*—Harrington & Smith, PC

(57) ABSTRACT

This contact includes a closed-section crimp barrel, which is crimped by deforming the section thereof from an initial generally convex shape to a final crimping shape in which it is compression-necked onto the strands of the cable. At least one section of the crimped barrel has, in its thickness, at least two adjacent indentations, which extend along the outer periphery of said section and which are directed inward. The invention also relates to a method of crimping such a contact and to a corresponding crimping tool.

21 Claims, 4 Drawing Sheets

METHOD AND APPARATUS FOR CRIMPING A CONTACT

The invention relates to the field of electrical connectors and more specifically concerns an electrical contact that is crimped onto a cable with multiple conducting strands, comprising a closed-section crimp barrel, which is crimped by deforming the section thereof from an initial generally convex shape to a final crimped shape in which it is compression-necked onto the strands of the cable.

The invention concerns, in particular, but not exclusively, "shell"-type contacts or sleeves for coupling or shunting between several cables and, still more particularly, electrical contacts for automobile vehicles. These particular types of contact are also referred to by the term "terminals."

The necking formed in the crimp barrel essentially has two functions, which consist, on the one hand, of ensuring a sufficient mechanical hold of the contact on the cable, enabling the composite to resist substantial traction forces, and, on the other hand, of ensuring a good electrical continuity between the strands of the cable as well as between the cable and the contact.

One important cause of deterioration of this electrical continuity consists in the penetration of moisture or of other corrosive agents or particles present in the surrounding atmosphere into the interior of the barrel or between the strands. Thus, it is necessary to minimize these phenomena by ensuring in a durable manner a good water- and airtightness between the strands on the one hand, and between the strands and the barrel on the other hand.

It is therefore essential that the necking formed in the crimp barrel not only ensures a satisfactory compression of the strands in the barrel, but, in addition, maintains these strands in an optimal arrangement throughout the life of the contact.

In prior art, the contacts of the above-mentioned type generally have conduction performances that are markedly inferior to the performances specified when a form of necking is designed and is supposed to be optimal for a given type of contact and a given type of cable. Is has been found that these deviations in performance are due in large part to a phenomenon of elastic rebound of the barrel, which occurs immediately at the end of the die stamping operation that allows the necking on the cable to be formed. This phenomenon of elastic rebound, also referred to as "spring back," brings about a loosening of the strands of the cable and thus the re-formation of interstices between the latter, which is detrimental to conduction performance.

Observed in prior art, on the other hand, is the fact that the strands are often compressed and deformed in a heterogeneous manner; that is, the compression is correct only in certain parts of the section of the cable.

In order to improve the electrical continuity and the resistance to traction in open crimp contacts, it has already been proposed to form indentations in the crimp barrel. Reference may be made, for example, to U.S. Pat. No. 5,901,439 on this subject.

However, when it is applied to open crimpings, this solution has been found to be unsatisfactory due to the fact that the indentations could "injure" the core of the cable by cutting some of the conducting strands.

For closed-barrel contacts, one possibility of improvement consists in increasing the necking. However, this possibility is limited, because, above a certain value and with the methods used at present, there is quite substantial formation of fins in the junctions between the parts of the tool used.

The objective of the invention is to remedy these drawbacks and to propose a crimping that, for the closed-barrel contacts of the above-mentioned type, ensures an optimal contact between the strands of the cable on the one hand and between the cable and the contact on the other hand. The objective of the invention is also to ensure the stability of the electrical connection at the end of the necking operation and throughout the life of the electrical connection.

The invention also has for objective a reduction in the risks of corrosion, the water- and airtightness being ensured by limiting the interstices between the strands of the cable on the one hand and between the cable and the contact on the other hand.

For this purpose, in accordance with the invention, at least one first section of the crimped barrel has, in its thickness, at least two adjacent indentations, which extend along the outer periphery of said section and are directed inward.

According to other, optional characteristics of the invention:

- said two indentations are adjacent, so as to define a double W-shaped indentation;
- said crimped barrel section is symmetrical in relation to at least one first central transverse axis;
- said crimped barrel section is symmetrical in relation to a second central transverse axis that is perpendicular to the first axis;
- said crimped barrel section has two other indentations, which are symmetrical to the preceding ones in relation to said first central transverse axis;
- said crimped barrel section has exclusively four indentations;
- the crimped barrel has, in a second section, which is axially displaced in relation to the first section, indentations analogous to those formed in said first section;
- the crimped barrel section has an generally polygonal outer shape;
- each pair of adjacent indentations is formed on the same edge of the polygonal shape;
- the crimped barrel section has an generally hexagonal outer shape; and
- the indentations are provided for imparting to the conducting strands, inside the barrel, a homogeneous deformation, independently of their individual position inside the barrel.

The invention also concerns a method of crimping an electrical contact having a closed-section barrel, which is initially convex in shape, onto a cable with multiple conducting strands in order to produce a crimped contact of the type described above. This method comprises successive steps that consist of:

- inserting the cable end to be crimped into the barrel of the contact; and
- compression-necking the barrel onto the cable by a die stamping operation in such a manner as to impart to the barrel a intermediate necked form that is generally convex in cross section, and it is characterized in that is comprises, in addition, a punching operation, by means of which the indentations are formed in the barrel, said punching operation being performed after the die stamping operation.

According to other optional characteristics of the inventive method:

- the intermediate necked shape is generally polygonal, particularly hexagonal;
- the die stamping operation is carried out by means of a two-part die, which is squeezed onto the barrel so as to close the die, and the punching operation is carried out while the die is kept closed, the two parts of the die being kept pressed against each other; and the punching operation is carried out by means of a sucker punch for each pair of adjacent indentations.

Finally, the invention concerns a crimping tool for implementing a method such as described above, comprising:

a die in two parts, which define, in the interior, a stamp corresponding to the intermediate necked shape to be imparted to the barrel, a means of relative movement of the two parts of the die, at least one punch for making the indentations in the barrel, and a means of movement of said punch.

The inventive tool is characterized in that the means of movement of the punch are linked to those of the die parts in such a way that, during a crimping operation, the punch is moved from a retracted position, in which it is disengaged from the stamp of the die, to an active position, in which it projects into the interior of the stamp after the die is closed.

According to other optional characteristics of the inventive tool:

the die defines, in its interior, a generally polygonal stamp, particularly a hexagonal stamp;

the tool comprises at least one punch with at least two teeth, which are provided for jointly making two indentations;

the tool comprises two punches, which are symmetrical in relation to a plane in which the die is squeezed, and the associated means of movement are appropriate for moving them in a symmetrical manner in relation to this plane; and the means of movement of the said punch(s) are dependent on the means of relative movement of the two parts of the die in such a manner that the movement of the punch(s) from its (their) retracted position is possible only after the die has been closed.

According to a first embodiment of the invention, the means of movement of the two parts of the die and the means of movement of the punches comprise a joint drive motor and transmission units with respective cams, by means of which the parts of the die, on the one hand, and the punches, on the other hand, are linked to said drive motor.

According to a second embodiment of the invention, the means of movement of the two parts of the die and the means of movement of the punch comprise separate drive motors, the means of movement of the parts of the die comprising a means of control of their relative position and the means of movement of the punch comprising a means of controlling the associated motor, subject to the said means of control.

One particular embodiment of the invention will now be described in greater detail with reference to the attached drawings, in which.

Figure 5:
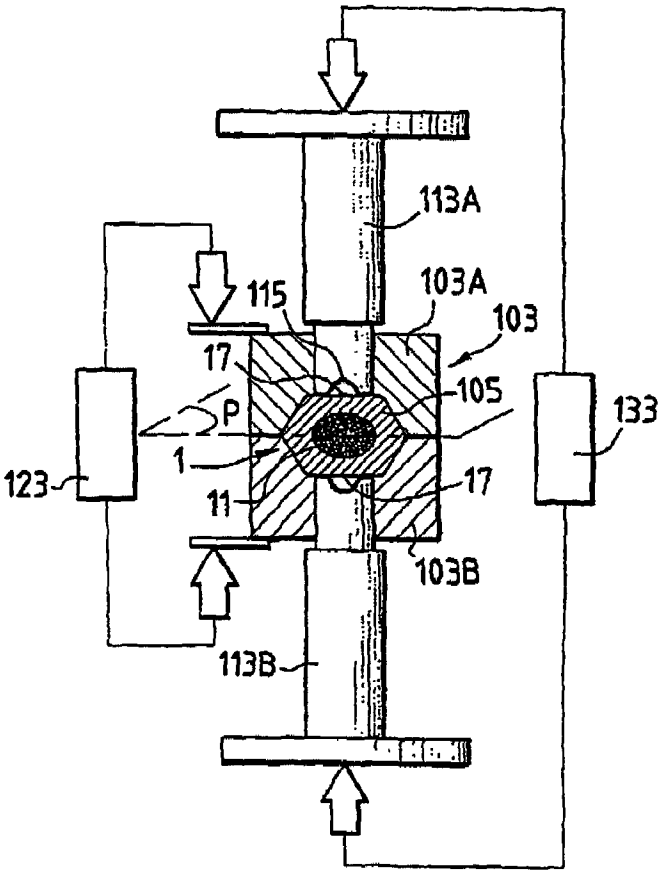
Figure 4:
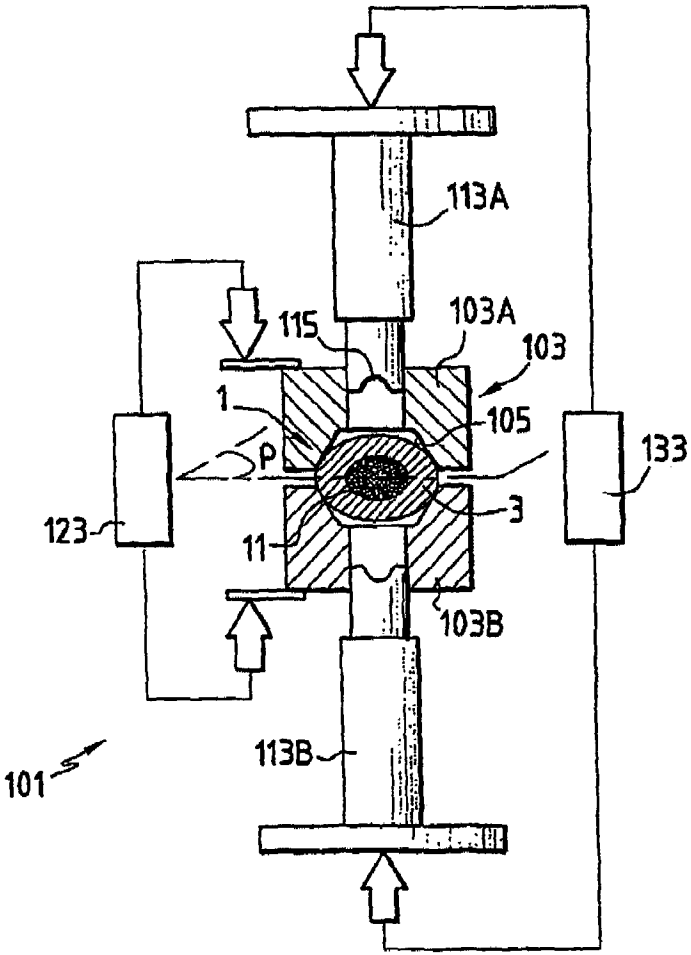
Figure 7:
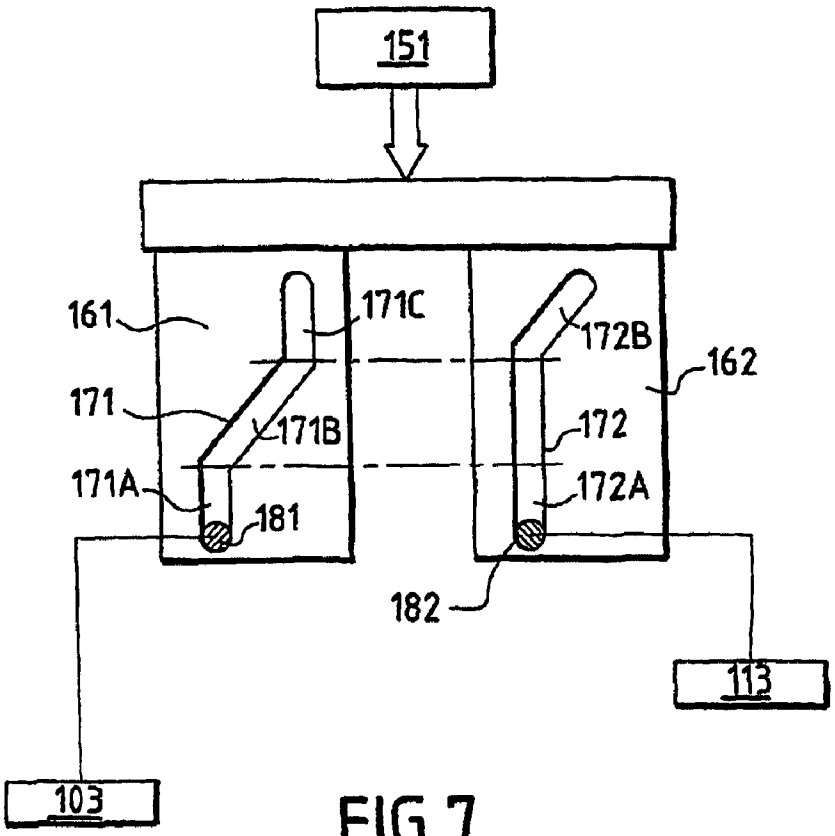
Figure 6:
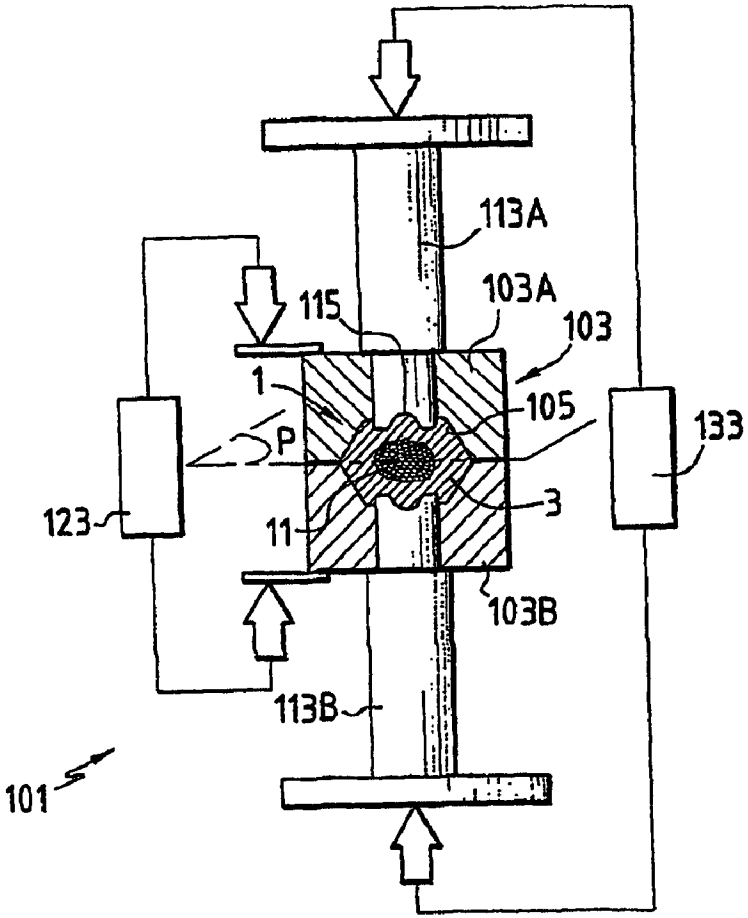

FIGS. 4 to 6 schematically depict, in three successive steps of the crimping method in accordance with the invention, the sleeve connector, the cable, and the crimping tool; and FIG. 7 is a schematic view of one part of the crimping tool of the invention.

Figure 1:
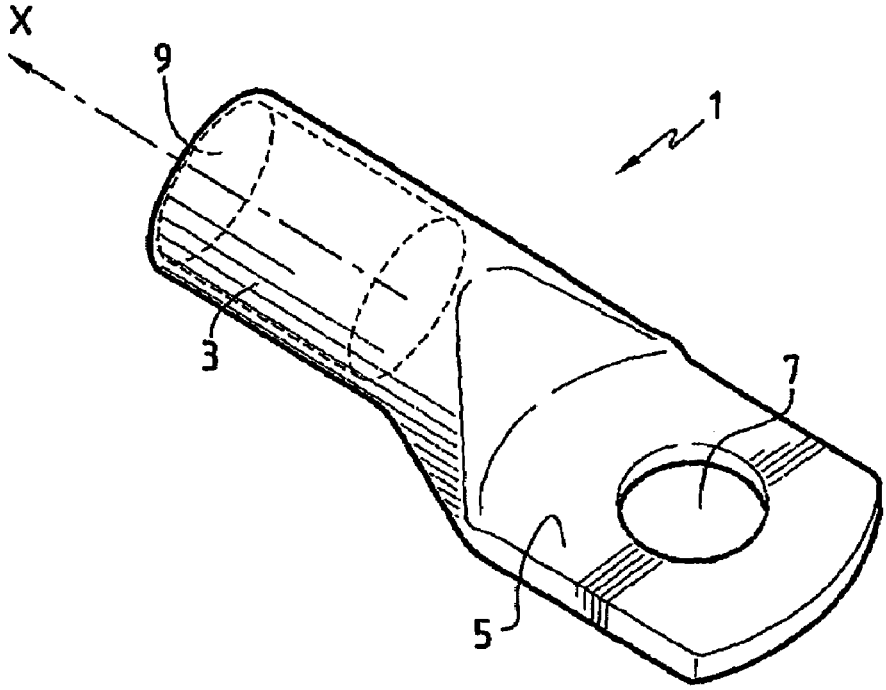
FIG. 1 is a perspective view of a sleeve connector, prior to crimping, of a type intended, more specifically, by the invention.

Depicted in FIG. 1 is a contact of a type intended, more specifically, by the invention, namely, a sleeve connector or terminal. This sleeve connector 1 takes the form of a metallic tip for crimping at the end of a stripped cable, this tip being composed essentially of a tubular body 3, which forms a crimp barrel, and a flat part 5. The flat part 5 is furnished with a through-bore 7, which is provided for inserting a fastening screw.

The crimp barrel 3 has, on the end opposite the flat part 5, an open end 9 for introducing a cable.

The crimp barrel 3 has a closed section, which is oval in the example depicted. The closed section could be of any other generally convex, appropriate shape that is capable of facilitating the insertion of the end of the cable being connected into the barrel 3. For example, the cross section of the crimp barrel could be, in a very common manner, circular.

Sleeve connectors of this type could be appropriate, for example, for the connection of cables having a cross section lying between 6 and 40 $mm^2$ in applications involving electrical connections in automobile vehicles.

Figure 2:
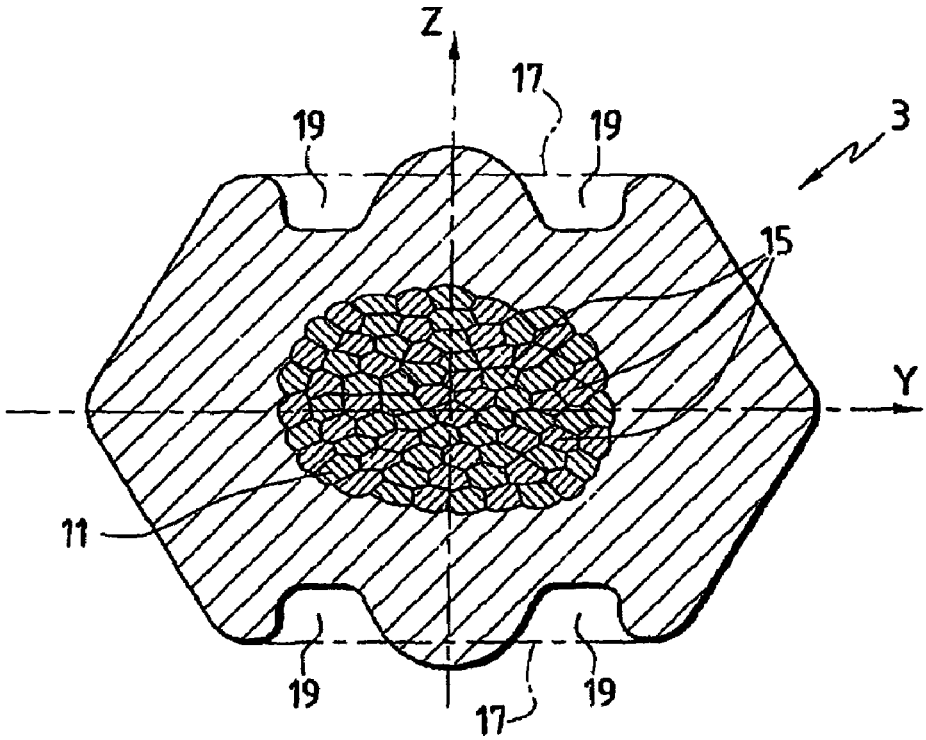
FIG. 2 is a sectional view, on an enlarged scale, in a transverse plane of the crimp barrel, of the sleeve connector of FIG. 1, crimped in accordance with the invention.

Depicted in FIG. 2 is a cross section of the crimp barrel 3 after crimping onto a cable 11 that has multiple conducting strands 15 in accordance with the invention.

The portion of the crimp barrel 3 that has been deformed by being necked onto the cable 11 in order to carry out the crimping has, in the example depicted, a generally polygonal shape and, more specifically, a generally hexagonal shape. Two opposite edges 17 of the hexagon are parallel and longer in length than the other edges. Each of these edges 17 is deformed by two adjacent indentations 19, which are directed toward the interior of the thickness of the barrel. Still more specifically, the two indentations 19 that are formed on the same edge 17 are adjacent and define a profile, or double indentation, having a W shape.

In the example depicted, the crimped section of the barrel 3 depicted in FIG. 2 has a double symmetry: first, in relation to a central transverse Y axis, which is parallel to the two main edges 17, and, second, in relation to a central transverse Z axis, which is orthogonal to the Y axis. The Z axis corresponds to the axis of symmetry of the W-shaped profile of the double indentation 19.

Figure 3:
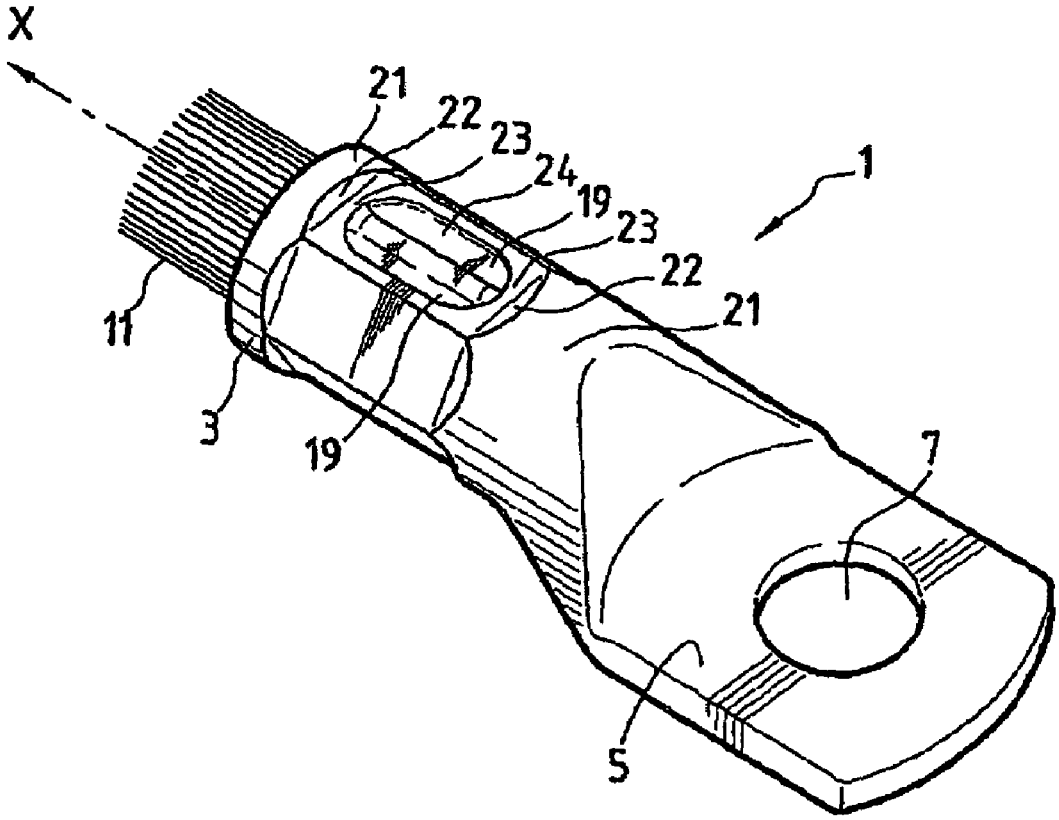
FIG. 3 is a perspective view, analogous to FIG. 1, of the crimped sleeve connector of FIG. 2.

As illustrated in FIG. 3, the crimping in accordance with the invention is preferably accomplished by carrying out a hexagonal necking on a first portion of the crimp barrel 3, extending along the large part of the length (in the X direction) of the latter, and by forming the indentations 19 on only one portion of this length. Thus, the crimp barrel 3, once it has been crimped on the cable 11, can have, in succession, starting from each of its ends:

a section 21 of outer oval or circular or other shape, which is identical or virtually identical to the initial outer shape, a transition portion 22, a portion 23 with a hexagonal profile that is devoid of indentation, and a portion 24 with a hexagonal cross section and indentations, such as depicted in FIG. 2. In the example depicted, the indentations are made in a region of generally oblong (or oval) outer shape, which extends axially.

In accordance with one embodiment of the invention that has not been depicted, the crimped barrel can have two distinct portions 24 that are of the same type and are shifted axially (along the X axis), on which are formed indentations 19 that are analogous or identical. These two portions are thus separated in the example chosen by one portion of hexagonal cross section without indentations.

It will be noted, in addition, in reference once again to FIG. 2, that, due to the shape of the crimping imparted to the barrel, the strands 15 of the cable, viewed in cross section, have a composite cohesion and a tight fit that affords an optimal mutual contact surface with very few interstices between them or with the walls of the barrel. It will noted as well that, under the effect of a roughly isotropic pressure, the individual strands have taken on roughly hexagonal cross sections, which correspond to the structure referred to as "honeycombed." The strands 15 also have, in cross section, a distribution according to a generally rectangular shape.

In reference to FIGS. 4 to 6, the main steps of a method in accordance with another aspect of the invention, making it possible to crimp an electrical contact of the above-described type in accordance with the configuration described above, will now be described.

Also to be described are the main elements of a tool in accordance with another aspect of the invention, which makes it possible to implement this method.

Depicted in FIG. 4 is the sleeve connector 1 of FIG. 1, in a cross section in the crimp barrel 3 thereof, in its initial state, prior to crimping.

As mentioned above, the barrel 3 has a generally convex cross-sectional shape and, more specifically, in the example depicted, an oval shape. The stripped section of the cable 11 to be crimped is depicted inserted into the interior of the barrel 3.

Also depicted in FIG. 4 is the crimping tool 101, in which is placed the sleeve connector 1, fitted beforehand on the end of the cable 11 to be crimped, so as the carry out a crimping in accordance with the invention.

This tool 101 comprises essentially a die 103, composed of two die parts 103A, 103B, which are largely symmetrical to each other in relation to a plane P, which will be referred to as the "crimping plane" and which defines in the interior between them, when they are assembled, the stamp 105 of a generally hexagonal shape that is to be imparted to the barrel. The symmetry of the die parts refers in reality to the symmetry of the stamps that they define.

The tool 101 comprises, on the other hand, a pair of punches 113A, 113B, which are also symmetrical in relation to the crimping plane P and make it possible to make the indentations 19. To do this, each of the punches 113A, 113B is movably mounted in the corresponding part of the die 103A, 103B, between a position in which it is disengaged from the stamp 105 and a position in which it projects into the interior of the stamp 105, as will be seen elsewhere. Naturally, the active end of each punch is formed with a stamp 115 having two teeth, corresponding to the shape of the indentations 19.

In the example depicted, each of the double indentations 19, in a W shape, is formed by means of a single punch 113A, 113B.

The tool 101 is also equipped with a means of movement of the parts of the die 103, which is schematically shown in the figures under the reference 123, and a means of movement of the punches 113A, 113B, which is schematically shown under the reference 133.

The term "movement" is understood to mean a relative movement of the die parts or of the punches in relation to an imaginary crimping plane P. Naturally, in relation to the frame of a machine containing the tool 101, one of the two die parts, 103, may be fixed and solely the other part 103A is moved in order to squeeze the die. Since, as reference, the plane of symmetry P of the two die parts is taken, this plane being referred to as the "crimping plane," the two die parts 103A, 103B are driven, in the course of the crimping operation, by a symmetrical movement. In the same way, in relation to the crimping plane P, the punches 113A, 113B are also driven by a symmetrical movement.

Depicted in FIG. 5 is the tool 101 and the crimp barrel 3 of the sleeve connector in an intermediate crimping configuration.

In this configuration, the barrel is compression-necked onto the cable in a generally convex—here, hexagonal—intermediate necked shape, which corresponds to the general shape of the crimped barrel described in FIG. 2.

This intermediate necked shape is obtained by a die stamping operation that consists in closing the die 103 and squeezing the two die parts 103A, 103B, the punches 113A, 113B being disengaged from the stamp 105, as illustrated in FIG. 5.

Depicted in FIG. 6 is the tool 101 and the barrel 3 in the final crimping state at the end of a punching operation.

In the course of this punching operation, the necked barrel is struck, depending on its intermediate shape, in the region of the two opposite main edges 17 by means of the two punches 113A, 113B in such a way as to form the indentations 19 described above.

In the configuration of FIG. 6, that is to say, at the end of the punching operation, the active parts of the punches 113A, 113B project into the interior of the stamp 105 of the die and are embedded into the thickness of the material constituting the barrel 3.

It is important to note, as illustrated in FIGS. 5 and 6, that the punching operation is carried out after the die stamping operation and not in a simultaneous manner. It is in this way that the conducting strands 15 are crimped in a first arrangement during the die stamping operation, which imparts to the barrel its intermediate necked form, and are afterwards locally moved by the punching operation. The strands then assume their final arrangement, such as depicted in FIG. 2.

It is also important to note that the punching operation is carried out while the die 103 is kept closed, with squeezing of the two die parts 103A, 103B.

It will noted, moreover, that this prevents the formation of fins between the two die parts.

The successive movement of the die parts 103A, 103B, on the one hand, and of the punches 113A, 113B, on the other hand, may be accomplished by different means.

Regardless of the case, the means of movement 133 of the punches and the means of movement 123 of the die parts are preferably linked in such a way that the punches are retracted, that is, disengaged from the stamp 105, during the die stamping operation and that they are activated solely at the end of the latter. They also interact in such a way that the die parts are able to open only at the end of the punching operation.

By way of example, the means of movement 123, 133 may be equipped with distinct drive motors and a means of control appropriate for controlling, on the one hand, the relative position of the die parts and, on the other hand, the position of the punches. In particular, the means of movement 123 may be equipped with a means of control (of any appropriate type) of the relative position of the two die parts 103A, 103B and the means of movement 133 may comprise a means of controlling the associated motor, which is subject to the means of control of the position of the die parts.

In another embodiment, which has been illustrated schematically in FIG. 7, the means of movement 123, 133 are equipped with a joint drive motor 151 and with cam transmission units 161, 162, linking the motor 151 to the two parts of the die 103 and to the punches 113, respectively.

As shown schematically in FIG. 7, the first cam unit 161 has a cam 171 with three segments 171A, 171B, 171C, which correspond to the three phases of movement of the die parts. During the crimping operation, the motor 151 moves downward (in the direction indicated in FIG. 7) the cam 171, which acts on one of the parts of the die 103 by way of the cam follower 181 engaged in the latter. Simultaneously and according to the same movement, the motor 151 moves the cam 172, which is composed of two segments 172A, 172B and which acts on one of the punches 113 by way of the cam follower 182 engaged in the latter. It is understood that the action of the motor produces the following successive phases:

(i) In a first stroke of the cams 171, 172, the follower 181 is moved in the vertical segment 171A, while the follower 182 is moved in a vertical rectilinear segment 172A in such a way that neither the die part 103 nor the punch 113 are moved (because the cams do not produce any action on the respective follower 181,182). This phase corresponds to a dead stroke of the output unit of the drive motor.

(ii) The follower 181 arrives afterwards in the inclined segment 171B in such a way that it is caused to undergo a movement that is oriented downward in the figure with the cam 171, which results in a movement of the die part 103. Simultaneously, the follower 182 continues move, without being induced to do so, in the vertical rectilinear segment 172A of the corresponding cam 172 in such a way that the punch 113 is not induced to undergo movement and remains immobile.

At the end of the stroke of the follower 181 in the inclined segment 171B, the die parts 103 thus attain their squeezed position, in which they are kept until the end of the crimping operation.

(iii) In a third functional phase, corresponding to a third segment 171C of the cam 171, the movement of the cam 171 no longer induces an effect on the follower 181, because the segment 191C is oriented along the direction of movement of the output unit of the motor 151. After the follower 181 is engaged in the third segment 171C, the follower 181 comes into engagement in the second segment 172B of the cam 172. Since this segment 172B is inclined, it produces, during its vertical movement by the motor 151, an inducement downward of the follower 182, which brings about the movement of the corresponding punch 113 toward its active position.

The short preceding description, made with reference to FIG. 7, has explained one particular embodiment of a tool that makes it possible to accomplish, by means of a single drive motor and relatively simple transmission elements, successive and distinct operations of die stamping and of punching, which implement the method of crimping in accordance with the invention.

The invention claimed is:

1. A method of crimping an electrical contact having a closed-section barrel, which is initially generally convex in shape, onto a cable with multiple conducting strands in order to produce a crimped assembly, wherein the barrel is crimped by deforming a section of the barrel from the initially generally convex shape to a final crimped shape in which the section is compression-necked onto the strands of the cable in such a way that a first portion of the section has, in its thickness, at least two adjacent indentations, said method comprising succesive steps of:

inserting an end of the cable to be crimped into the barrel of the contact;

compression-necking the barrel onto the cable by a die stamping operation so as to impart to the barrel an intermediate necked form that is generally convex in cross section, and a punching operation, to form the indentations in the barrel, said punching operation being performed after the die stamping operation.

2. The method according to claim 1, wherein the intermediate necked shape is generally polygonal, particularly hexagonal.

3. The method according to claim 1, in that wherein the die stamping operation is carried out by means of a die in two parts, which is squeezed onto the barrel so as to close the die, and the punching operation is carried out while the die is kept closed, the two parts of the die being kept pressed against each other.

4. The method according to claim 3, wherein the punching operation is carried out by means of a single punch for each pair of adjacent indentations.

5. The method according to claim 1 wherein said two indentations are formed adjacent in such a way as to define a double indentation in a W shape.

6. The method according to claim 5 wherein said section is formed with a symmetry in relation to at least one first central transverse axis (Y)

7. The method according to claim 6, wherein said section is formed with a symmetry in relation to a second central transverse axis (Z), which is perpendicular to the first axis.

8. The method according to claim 6, wherein said section is formed with two other indentations, which are symmetrical to the indentations of claim 1 in relation to said first central transverse axis (Y)

9. The method according to claim 8, wherein said section of crimped barrel is formed with only the four indentations.

10. The method according to claim 5, wherein the barrel is formed, in a second portion that is axially displaced in relation to the first portion, with second indentations that are analogous to the indentations formed in said first portion.

11. The method according to claim 5, in that wherein the section of the barrel is formed with a generally polygonal outer shape.

12. The method according to claim 11, in that wherein each pair of adjacent indentations is formed on a same edge of the polygonal shape.

13. The method according to claim 11, wherein the section of the barrel is formed with a generally hexagonal outer shape.

14. The method according to the claim 5, in that wherein the indentations impart to the conducting strands, in the interior of the barrel, a homogeneous deformation, independently of their individual position in an interior of the barrel.

15. A crimping tool comprising:

a die in two parts, which define, in an interior, a stamp corresponding to an intermediate necked shape to be imparted to a barrel, for moving the two parts of the die relative to each other, at least one punch for making indentations in the barrel, and for moving said punch, wherein the means for moving the punch are linked to the means for moving the two parts of the die in such a way that, during a crimping operation, the punch is configured to be moved from a retracted position, in which the punch is disengaged from the stamp of the die, to an active position, in which the punch projects into the interior of the stamp after the die is closed.

16. The tool according to claim 15, wherein the stamp is generally hexagonal.

17. The tool according to claim 15, wherein the at least one punch comprises at least two teeth, which are provided for jointly making two of the indentations.

18. The tool according to claim 17, wherein the at least one punch comprises two punches, which are symmetrical in relation to a crimping plane (P) of the die, and the means for moving the punch is configured for displacing the punches in a symmetric manner in relation to this plane (P)

19. The tool according to claim 15, wherein the at least one punch is dependent on the means for moving the two die parts such that the movement of the at least one punch from its retracted position is possible only after the die has been closed.

20. The tool according to claim 15, wherein the means for moving the two parts of the die and the means for moving the punches comprise a joint drive motor and transmission units with respective cams, by means of which the parts of the die, on the one hand, and the punches, on the other hand, are linked to said drive motor.

21. The tool according to claim 15, wherein the means for moving the two parts of the die and the means for moving the punch comprise distinct drive motors, the means of for moving the die parts comprising a means of control of their relative position and the means for moving the punch comprising a means for controlling the associated motor, wherein the means for controlling the associated motor is subject to the said means of control.

* * * * *

UNITED STATES PATENT AND TRADEMARK OFFICE

CERTIFICATE OF CORRECTION

PATENT NO. : 7,484,294 B2
APPLICATION NO. : 10/587650
DATED : February 3, 2009
INVENTOR(S) : De Keyser et al.

It is certified that error appears in the above-identified patent and that said Letters Patent is hereby corrected as shown below:

Claim 3, column 8, line 1, please delete “in that”.

Claim 11, column 8, line 29, please delete “in that”.

Claim 12, column 8, line 32, please delete “in that”.

Claim 14, column 8, line 38, please delete “in that”.

Claim 15, column 8, line 48, after “and” insert --means--.

Claim 21, column 10, line 3, please delete “of”.

Signed and Sealed this

Sixteenth Day of June, 2009

JOHN DOLL
*Acting Director of the United States Patent and Trademark Office*